US011873693B2

(12) United States Patent
Javed et al.

(10) Patent No.: US 11,873,693 B2
(45) Date of Patent: Jan. 16, 2024

(54) CUTTING A VALVE WITHIN A WELL STACK

(71) Applicant: Saudi Arabian Oil Company, Dhahran (SA)

(72) Inventors: Muhammad Imran Javed, Abqaiq (SA); Sanjiv Kumar, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/828,795

(22) Filed: May 31, 2022

(65) Prior Publication Data

US 2023/0407722 A1 Dec. 21, 2023

(51) Int. Cl.

| | |
|---|---|
| ***E21B 31/16*** | (2006.01) |
| ***E21B 33/068*** | (2006.01) |
| ***E21B 31/20*** | (2006.01) |

(52) U.S. Cl.

CPC ..... *E21B 31/16* (2013.01); *E21B 31/20* (2013.01); *E21B 33/068* (2013.01)

(58) Field of Classification Search

CPC ..... E21B 29/00; E21B 29/002; E21B 29/02; E21B 31/06; E21B 31/16; E21B 33/03; E21B 33/06; E21B 34/02

See application file for complete search history.

(56) References Cited

U.S. PATENT DOCUMENTS

| | | | | |
|---|---|---|---|---|
| 3,871,485 A | | 3/1975 | Keenan, Jr. et al. | |
| 5,544,707 A | * | 8/1996 | Hopper | E21B 34/02 166/368 |
| 6,041,860 A | * | 3/2000 | Nazzal | E21B 33/127 73/152.01 |
| 8,684,088 B2 | * | 4/2014 | Zediker | E21B 7/12 166/361 |
| 8,720,575 B2 | * | 5/2014 | Zediker | E21B 34/045 166/361 |
| 9,089,928 B2 | * | 7/2015 | Zediker | B23K 26/0096 |
| 9,138,786 B2 | | 9/2015 | McKay et al. | |
| 9,664,012 B2 | * | 5/2017 | Deutch | E21B 43/11 |
| 9,669,492 B2 | * | 6/2017 | Linyaev | B23K 26/38 |
| 11,708,736 B1 | * | 7/2023 | Mukhles | E21B 29/08 166/55.1 |
| 2012/0074110 A1 | * | 3/2012 | Zediker | E21B 10/60 219/121.72 |

(Continued)

FOREIGN PATENT DOCUMENTS

| | | | | |
|---|---|---|---|---|
| CN | 104499943 A | * | 4/2015 | E21B 10/00 |
| CN | 112253027 A | * | 1/2021 | E21B 29/00 |

(Continued)

OTHER PUBLICATIONS

International Search Report and Written Opinion in International Appln. No. PCT/US2023/023232, dated Aug. 18, 2023, 15 pages.

*Primary Examiner* — Jennifer H Gay
(74) *Attorney, Agent, or Firm* — Fish & Richardson P.C.

(57) ABSTRACT

A cylindrical main body is configured to be inserted into a well tree. A laser emitter is attached to the main body. The laser emitter is arranged to emit a laser beam configured to cut through a metal valve within a well tree. The laser emitter is arranged to emit the laser beam towards the metal valve. A magnet is on a distal end of the body. The magnet is arranged to magnetically capture a sliced portion of the metal valve cut by the laser beam.

12 Claims, 4 Drawing Sheets

(56) References Cited

U.S. PATENT DOCUMENTS

| | | | | |
|---|---|---|---|---|
| 2012/0217019 | A1* | 8/2012 | Zediker | E21B 34/045 166/381 |
| 2013/0220626 | A1* | 8/2013 | Zediker | E21B 33/063 166/336 |
| 2013/0319984 | A1* | 12/2013 | Linyaev | B23K 26/106 219/121.72 |
| 2014/0090846 | A1* | 4/2014 | Deutch | E21B 33/13 166/376 |
| 2014/0231085 | A1* | 8/2014 | Zediker | B23K 26/38 219/121.72 |
| 2017/0022777 | A1* | 1/2017 | Allen | E21B 34/02 |
| 2018/0179845 | A1 | 6/2018 | Pallin et al. | |
| 2022/0105592 | A1* | 4/2022 | Zediker | B23K 26/0622 |
| 2023/0243223 | A1* | 8/2023 | Mukhles | E21B 34/02 166/55.1 |

FOREIGN PATENT DOCUMENTS

| | | | | | |
|---|---|---|---|---|---|
| CN | 114458200 | A | * | 5/2022 | |
| GB | 2515858 | A | * | 1/2015 | E21B 29/00 |
| WO | WO 2019081934 | | | 5/2019 | |

* cited by examiner

CUTTING A VALVE WITHIN A WELL STACK

TECHNICAL FIELD

This disclosure relates to operations within a well stack, such as a well tree.

BACKGROUND

Production and injection wells often include a well stack, such as a well tree, atop a wellhead of the well. The well stack provides containment for the well and allows for access to the well when needed. The well stack itself typically includes a variety of valves and flow conduits conducive for each use case.

SUMMARY

This disclosure describes technologies relating to cutting a valve within a well stack.

One implementation of the subject matter described within this disclosure is a cutting system with the following features. A cylindrical main body is configured to be inserted into a well tree. A laser emitter is attached to the main body. The laser emitter is arranged to emit a laser beam configured to cut through a metal valve within a well tree. The laser emitter is arranged to emit the laser beam towards the metal valve. A magnet is on a distal end of the body. The magnet is arranged to magnetically capture a sliced portion of the metal valve cut by the laser beam.

Aspects of the example cutting system, which can be combined with the example cutting system alone or in combination with other aspects, include the following. Retractable anchors are attached to the main body. The retractable anchors are substantially flush with an outer surface of the main body when in a retracted position. The retractable anchors extend from the main body to intersect with an inner wall of a well tree when in an extended position. The anchors retain the main body in a set position when in the extended position. Centralizers are attached to and extend from the main body. The centralizers center the main body towards a center axis of the well tree.

Aspects of the example cutting system, which can be combined with the example cutting system alone or in combination with other aspects, include the following. A camera is arranged to observe a cutting surface.

Aspects of the example cutting system, which can be combined with the example cutting system alone or in combination with other aspects, include the following. The camera is retractable.

Aspects of the example cutting system, which can be combined with the example cutting system alone or in combination with other aspects, include the following. The lasers are retractable.

An example implementation of the subject matter described within this disclosure is a method with the following features. A valve installed within a well tree is cut through by a laser within a bore of the well tree. A cut portion of the valve is retained by a magnet.

Aspects of the example method, which can be combined with the example cutting method or in combination with other aspects, include the following. A tool is received by a well tree. The tool includes the laser and the magnet.

Aspects of the example method, which can be combined with the example cutting method or in combination with other aspects, include the following. Cutting involves extending the laser from a body of the tool and rotating the tool.

Aspects of the example method, which can be combined with the example cutting method or in combination with other aspects, include the following. The laser is retracted into the body of the tool.

Aspects of the example method, which can be combined with the example cutting method or in combination with other aspects, include the following. Anchors are extended from the body of the tool. The tool is secured within the well tree by the anchors.

Aspects of the example method, which can be combined with the example cutting method or in combination with other aspects, include the following. The tool and the cut portion are released by the well tree.

Aspects of the example method, which can be combined with the example cutting method or in combination with other aspects, include the following. Water is flowed through the well tree while cutting.

Aspects of the example method, which can be combined with the example cutting method or in combination with other aspects, include the following. Kill fluid is pumped into the well tree after cutting.

An example of the subject matter described within this disclosure is a system with the following features. A well tree includes a valve to be cut. A well tree tool is within the well tree. The well tree tool includes the following features. A main body has a diameter small enough to be inserted into the well tree. A laser emitter is attached to the main body. The laser emitter is arranged to emit a laser beam of sufficient power to cut through a metal valve, in a downhole direction. The laser emitter is retractable into the main body. A magnet is on a downhole end of the tool. The magnet is arranged to retain a sliced portion of the metal valve cut by the laser beam. Retractable anchors are attached to the main body. The retractable anchors are substantially flush with an outer surface of the main body when in a retracted position. The retractable anchors extend from the main body to intersect with an inner wall of a well tree when in an extended position. The retractable anchors retain the main body in a set position when in the extended position. Centralizers are attached to and extend from the main body. The centralizers center the main body towards a center axis of the well tree. A retractable camera is arranged to observe a cutting surface. The camera is retractable into the main body.

Aspects of the example system, which can be combined with the example system alone or in combination with other aspects, include the following. The well tree includes a first lateral valve and a second lateral valve down stack of the first lateral valve. The first lateral valve and the second lateral valve are configured to receive conduits to flow water through the conduits and the well tree.

Aspects of the example system, which can be combined with the example system alone or in combination with other aspects, include the following. The well tree includes packing glands upstack of the valve to be cut.

Aspects of the example system, which can be combined with the example system alone or in combination with other aspects, include the following. The well tree tool further includes the following features. A first motor is configured to move the rod in a direction parallel to the rod axis. A second motor is configured to rotate the laser emitter about an axis of the rod.

Particular implementations of the subject matter described in this disclosure can be implemented so as to realize one or more of the following advantages. The apparatus and methods described herein reduce the likelihood of debris from falling into the wellbore during repair operations. The other integrated tools described herein, along with a laser emitter, help in removing the cutting objects and provide live monitoring on the progress of the operation. The magnetic tool attached helps remove the cuttings of the valve while a high resolution camera will provide progress on the operation. The other benefits include time saving, better operational control, improved safety due to lesser footprint and simple operations, less heat generation by avoiding metal to metal friction, no chances of getting stuck, and miss-alignment and low tool maintenance cost.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Replacing a production tree requires removal of the primary pressure control barrier, i.e., the production tree valves. Thus, a kill fluid must be pumped into the well to act as the primary pressure control barrier prior to removal of the production tree. However, when one of the primary pressure control valves are unable to open, the kill fluid is unable to be pumped into the well. Thus, the broken valve must be drilled/milled through to access the well and pump the kill fluid.

Figure 1:
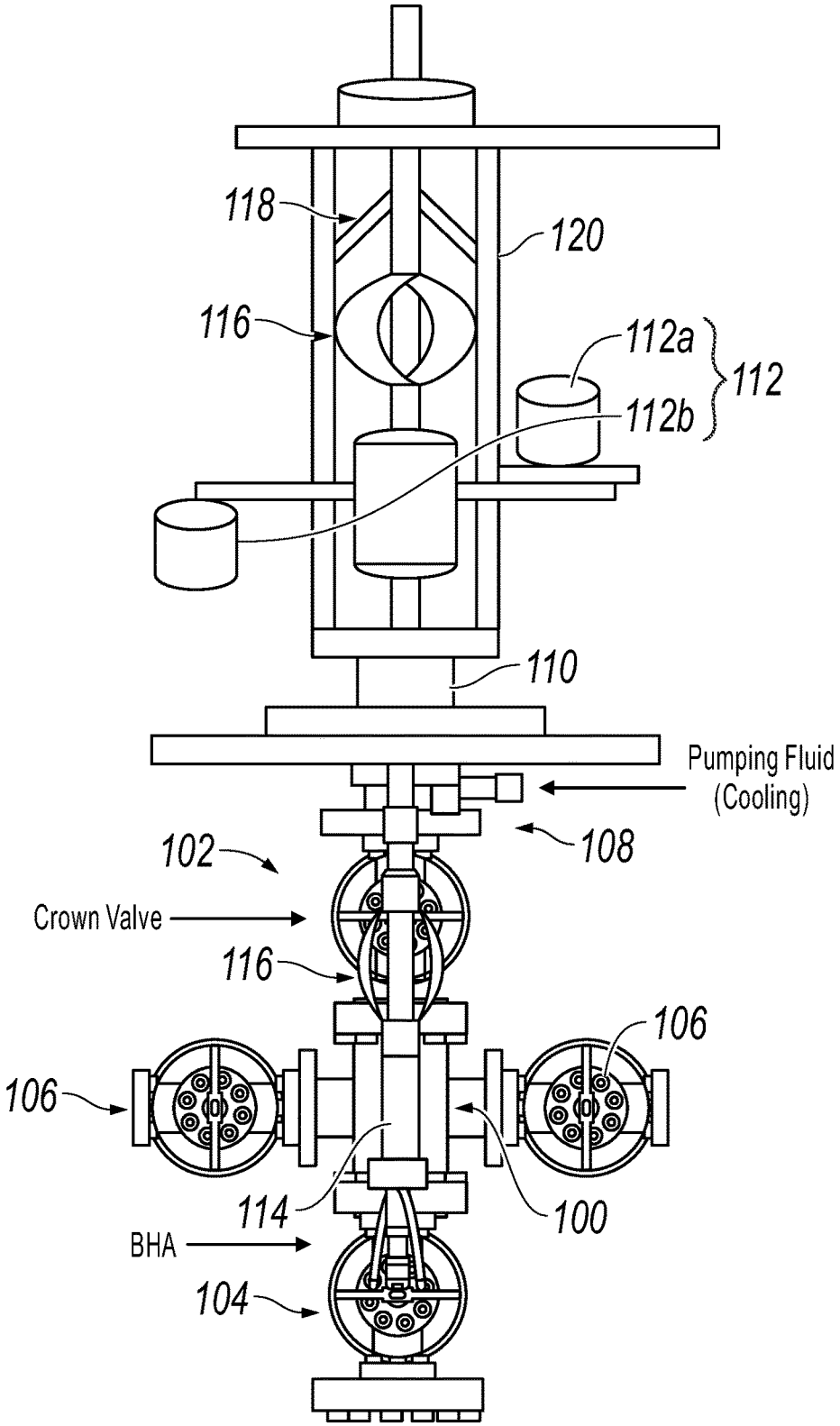
FIG. 1 is a side schematic view of an example well tree tool within a well tree.

As such, well stack valves becoming stuck in a closed position eliminates options to intervene and service a well. That is, remedial work cannot be performed in relation to either well production or well integrity management. This disclosure relates to a cutting system with a cylindrical main body configured to be inserted into a well stack, such as a well tree. A laser emitter is attached to the main body. The laser emitter is arranged to emit a laser beam configured to cut through a metal valve within a well tree. A magnet is on a distal end of the tool body. The magnet is arranged to magnetically capture a sliced portion of the metal valve cut by the laser beam FIG. 1 is a side schematic view of an example well tree tool 100 within a well tree 102. The well tree 102 includes a valve to be cut, such as the master valve 104. Valves within a well tree may need to be cut for a variety of reasons, for example, in instances when the valves are seized in a closed position. While this disclosure primarily describes cutting the master valve 104, other valves within the main tree bore can be cut with the same or similar tools and procedures described herein. While primarily focusing on well trees, similarly stacked well control systems can use the same or similar tools and procedures described herein, for example, a blowout preventer or a frac stack.

The well tree 102 includes wing valves 106. The wing valves 106 are lateral valves that can be used to insert objects or flow fluid through a bore of the well tree 102. The well tree 102 includes an additional lateral valve 108 upstack of the wing valves 106. The wing valves 106 and the additional lateral valve 108 is configured to receive conduits to flow water through the conduits and the well tree 102. The well tree 102 also includes packing glands 110 uphole of the master valve 104. The packing glands 110 allow for pressure isolation between the packing glands 110 and the master valve 104 while the well tree tool 100 is within the well tree 102.

The well tree tool 100 itself includes a main body 114 configured to be inserted into a wellbore. That is, the well tree tool 100 has a diameter less than the bore of the well tree 102. Other tool cross-sectional shapes can be used without departing from this disclosure. The tool includes motors 112 to perform various functions, such as the rotational motor 112*a*, that is configured to rotate the main body 114, the retractable laser emitter 204 (see FIGS. 2A-2C), the retractable camera 206 (FIGS. 2A-2C), or a combination. A lifting motor 112*b* is configured to change elevation of the well tree tool 100 within the well tree 102. That is, the lifting motor 112*b* is configured to move the rod in a direction parallel to the rod axis.

In some implementations, the well tree tool 100 centralizers are attached to and extend from the main body 114. The centralizers 116 exert a force against an inner bore of the well tree 102 and guide the main body 114 towards a center axis of the well tree 102. The centralizers can include leaf springs or other centralizer arrangements.

In some implementations, the well tree tool 100 includes retractable anchors 118 attached to the main body 114. The retractable anchors are substantially flush with an outer surface of the main body 114 when in a retracted position. The retractable anchors 118 extend from the main body 114 to intersect with an inner wall of a well tree 102 or a separate tool surround 120 when in an extended position. The retractable anchors 118 retain the main body in a set, fixed position when in the extended position.

Figure 2A:
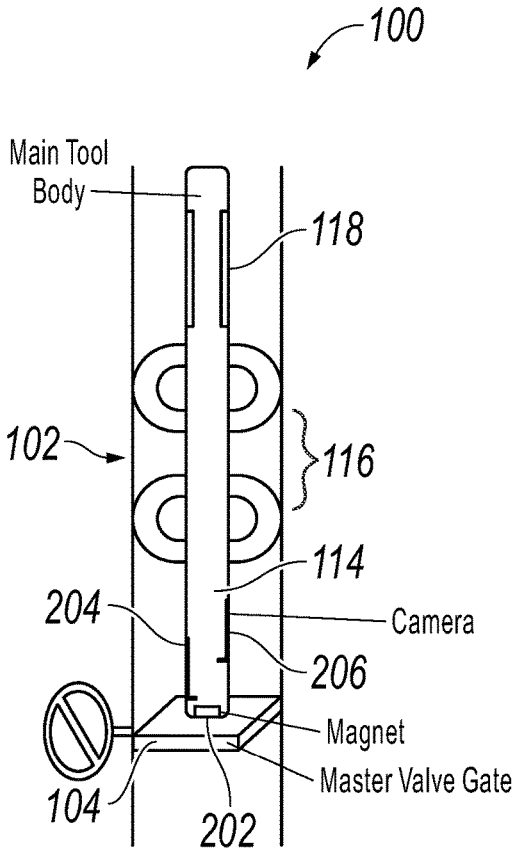
FIGS. 2A-2C are side views of the tool in various stages of operation.
Figure 2B:
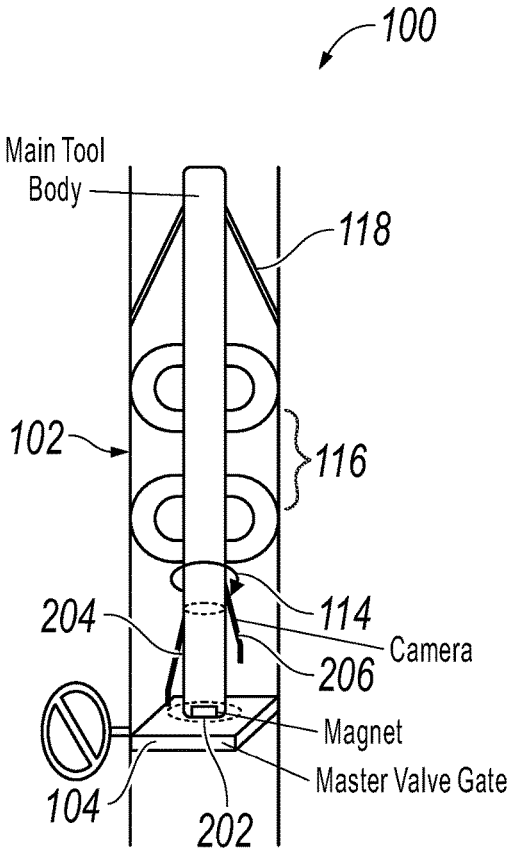
Figure 2C:
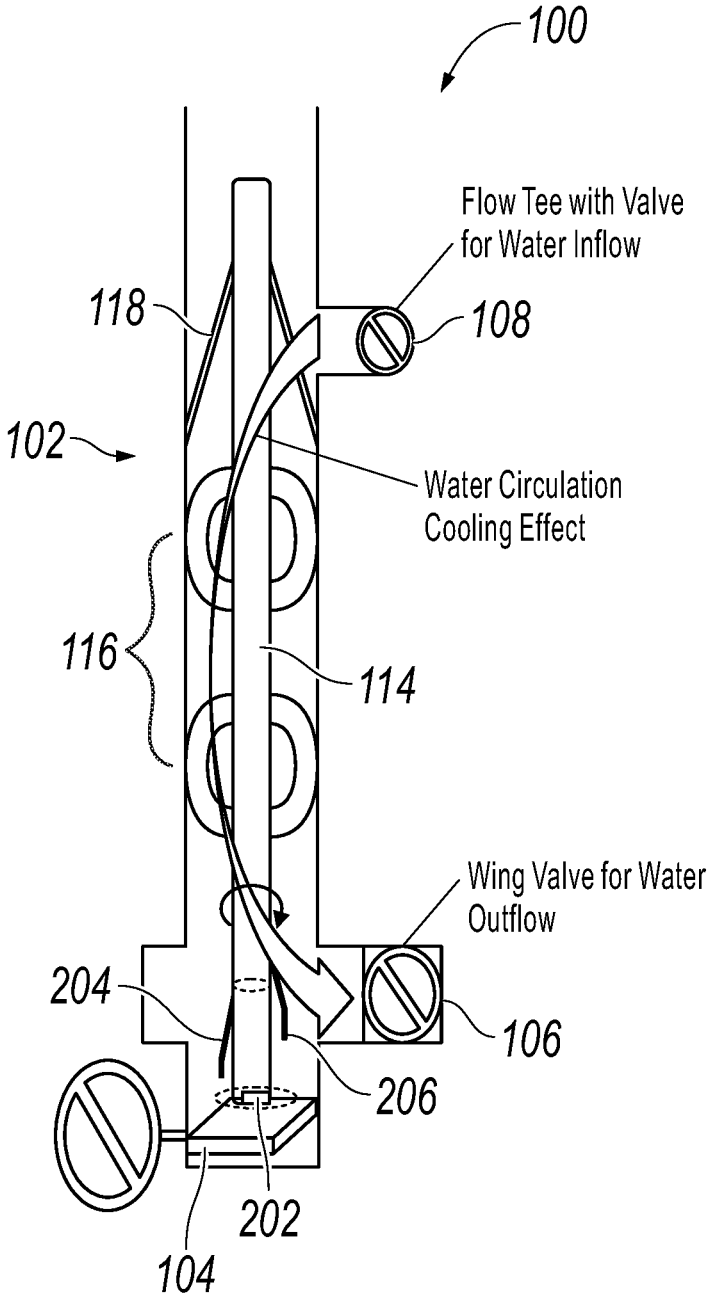

FIGS. 2A-2C are side views of the well tree tool 100 in various stages of operation. In FIG. 2A, the retractable anchors 118 are shown in the retracted state and the centralizers 116 are centering the well tree tool 100. At a distal end (downstack end) of the well tree tool 100 is a magnet 202 arranged to retain a sliced portion of metal valve cut by the laser beam. That is, the magnet 202 is arranged to magnetically capture a sliced portion of metal valve cut by the laser beam.

Just upstack of the magnet 202 is a retractable laser emitter 204. The retractable laser emitter 204 is attached to, and is retractable into, the main body 114. The retractable laser emitter 204 is arranged to emit a laser beam towards the master valve 104, for example, a downhole or downstack direction. The retractable laser emitter 204 is configured to emit a laser beam of sufficient power to cut through a metal valve.

The well tree tool 100 also includes a retractable camera 206 arranged to observe a cutting surface, such as a gate of the master valve 104. The retractable camera 206 is attached to, and is retractable into, the main body 114. In some implementations, the retractable laser emitter 204 and the retractable camera 206 are at a substantially same longitudinal location of the well tree tool 100. In some implementations, the retractable camera 206 and the retractable laser emitter 204 are on opposite sides of the well tree tool 100 at a same longitudinal location. Regardless of locations, the retractable camera 206 is arranged to view a cutting surface so that an operator, controller, or both, are able to observe cutting operations and determine what steps need be taken before, during, and after cutting operations.

Upstack of the retractable camera 206 and the retractable laser emitter 204 are retractable anchors 118 and centralizers 116. In some implementations, these items are arranged to enter the bore of the well tree 102 with the magnet 202, the retractable camera 206, and the retractable laser emitter 204.

During operations, as shown in FIG. 2B, the main body 114 is rotated. As shown in FIG. 2C, in some implementations, water or a similar clear liquid is flowed through the well tree 102, for example, between the wing valves 106 and the additional lateral valve 108. The flowing liquid is used to cool the well tree 102 and well tree tool 100 during cutting operations. In some implementations, the cooled portion of the well tree 102 is pressurized, for example to match a pressure downstack of the master valve. The pressure equalization allows for reduced stress during cutting operations and improves the likelihood that the cut portion of the valve is retained by the magnet 202.

In some implementations, communication to the retractable laser emitter 204, the retractable camera 206, the magnet 202, and retractable anchors 118 is done by a fiber optic cable running from the tool to a controller or control box (not shown). Similarly, in some implementations, fiber optic cables can carry control signals, status signals, or both, in between the various component of the well tree tool 100. Other communication systems can be used without departing from this disclosure, for example, electrical cables, wireless signals, or both can be used.

Figure 3:
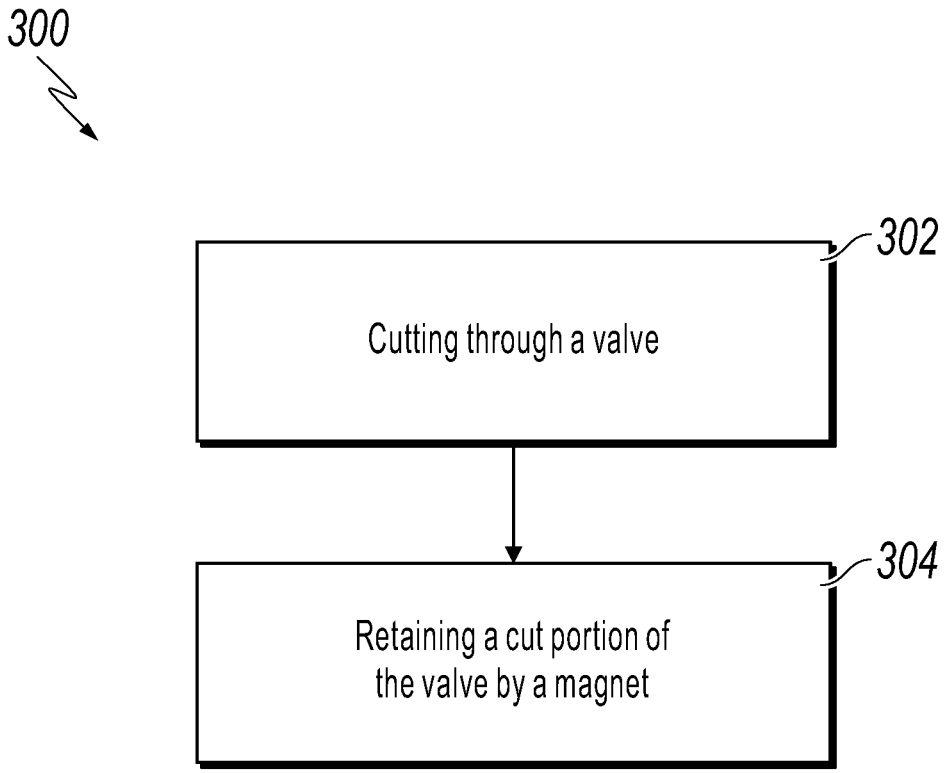
FIG. 3 is a flowchart of an example method that can be used with aspects of this disclosure.

FIG. 3 is a flowchart of an example method 300 that can be used with aspects of this disclosure. Prior to the method 300, a tool is received by a well tree. The tool includes a laser emitter arranged to emit a laser beam towards a distal end of the tool, and a magnet at the distal end of the tool. At 302, a valve installed within a well tree is cut through by the laser within the bore of the well tree. In some implementations, cutting the valve involves extending the laser emitter from a body of the tool and rotating the tool. In some implementations, anchors are extended from the body of the tool. The anchors secure the tool within the well tree. In some implementations, water is flowed through the well tree while cutting the valve. The flowing water cools the components during cutting operations.

At 304, a cut portion of the valve is retained by a magnet. In some implementations, kill fluid is pumped into the well tree after cutting. Such an action keeps the well safe, stable, and contained so that subsequent operations, such as replacing the well tree, can be performed. Once cutting, and in some cases, killing operations, are completed, extended components, such as the laser emitter, the anchors, and the camera, are retracted back into the body of the tool. The tool and the cut portion are then released from the well tree.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A cutting system comprising:

a cylindrical main body configured to be inserted into a well tree;

a laser emitter attached to the main body, the laser emitter arranged to emit a laser beam configured to cut through a metal valve configured to be positioned downhole of the main body within the well tree, the laser emitter arranged to emit the laser beam in a downhole direction towards the metal valve, wherein the laser emitter is retractable within the main body;

a magnet on a distal end of the body, the magnet arranged to magnetically capture a sliced portion of metal valve cut by the laser beam; and a camera arranged to observe a cutting surface, wherein the camera is retractable within the main body.

2. The cutting system of claim 1, further comprising:

retractable anchors attached to the main body, the retractable anchors being substantially flush with an outer surface of the main body when in a retracted position, the retractable anchors extending from the main body to intersect with an inner wall of a well tree when in an extended position, the anchors retaining the main body in a set position when in the extended position; and centralizers attached to and extending from the main body, the centralizers centering the main body towards a center axis of the well tree.

3. A method comprising:

running a well tool comprising a main body and a laser emitter configured to emit a laser into a bore of a well tree;

directing the laser emitted by the laser emitter into bore of the well tree within which a valve is installed, wherein the laser is directed in a downhole direction towards the valve;

cutting through the valve by the laser directed in the downhole direction towards the valve;

flowing water through the well tree while cutting;

retaining a cut portion of the valve by a magnet; and after cutting through the valve, retracting the laser emitter into the main body.

4. The method of claim 3, further comprising receiving, by the well tree, the well tool comprising the laser and the magnet.

5. The method of claim 4, wherein cutting comprises:

extending the laser emitter from the main body of the well tool; and rotating the well tool.

6. The method of claim 5, further comprising:

extending anchors from the body of the well tool; and securing the well tool, within the well tree, by the anchors.

7. The method of claim 4, further comprising releasing the well tool and the cut portion from the well tree.

8. The method of claim 3, further comprising pumping kill fluid into the well tree after cutting.

9. A system comprising:

a well tree comprising a valve to be cut; and a well tree tool within the well tree, the well tree tool comprising:

a main body having a diameter small enough to be inserted into the well tree;

a laser emitter attached to the main body, the laser emitter arranged to emit a laser beam, of sufficient power to cut through a metal valve, in a downhole direction, the laser emitter being retractable into the main body;

a magnet on a downhole end of the tool, the magnet arranged to retain a sliced portion of metal valve cut by the laser beam;

retractable anchors attached to the main body, the retractable anchors being substantially flush with an outer surface of the main body when in a retracted position, the retractable anchors extending from the main body to intersect with an inner wall of a well tree when in an extended position, the retractable anchors retaining the main body in a set position when in the extended position;

centralizers attached to and extending from the main body, the centralizers centering the main body towards a center axis of the well tree; and a retractable camera arranged to observe a cutting surface, the camera being retractable into the main body.

10. The system of claim 9, wherein the well tree comprises:

a first lateral valve; and a second lateral valve down stack of the first lateral valve, the first lateral valve and the second lateral valve configured to receive conduits to flow water through the conduits and the well tree.

11. The system of claim 9, wherein the well tree comprises packing glands upstack of valve to be cut.

12. The system of claim 9, wherein the well tree tool further comprises:

a first motor configured to move a rod in a direction parallel to the rod axis; and a second motor configured to rotate the laser emitter about an axis of the rod.

* * * * *